US007115311B2

(12) United States Patent
Arthurs et al.

(10) Patent No.: US 7,115,311 B2
(45) Date of Patent: Oct. 3, 2006

(54) ANTI-STATIC WOVEN FLEXIBLE BULK CONTAINER

(75) Inventors: Trevor Arthurs, Truro (CA); W. Keith Fisher, Suffield, CT (US)

(73) Assignee: Central Products Company, Menasha, WI (US)

( * ) Notice: Subject to any disclaimer, the term of this patent is extended or adjusted under 35 U.S.C. 154(b) by 328 days.

(21) Appl. No.: 10/691,788

(22) Filed: Oct. 23, 2003

(65) Prior Publication Data

US 2004/0086673 A1 May 6, 2004

Related U.S. Application Data

(62) Division of application No. 10/003,890, filed on Oct. 25, 2001, now Pat. No. 6,675,838.

(60) Provisional application No. 60/242,999, filed on Oct. 25, 2000.

(51) Int. Cl.
*B32B 1/00* (2006.01)

(52) U.S. Cl. ..... 428/36.2; 139/420 R; 139/420 A; 383/117; 428/36.1; 428/922; 442/186; 442/189

(58) Field of Classification Search ..... 428/36.1, 428/36.2, 922; 139/420 A, 420 R; 383/117; 442/189, 186

See application file for complete search history.

(56) References Cited

U.S. PATENT DOCUMENTS

| | | | |
|---|---|---|---|
| 3,470,928 | A | 10/1969 | Schwartz |
| 3,639,528 | A | 2/1972 | Patton et al. |
| 3,670,485 | A | 6/1972 | Brown et al. |
| 3,678,675 | A | 7/1972 | Klein |
| 3,690,057 | A | 9/1972 | Norris |
| 3,699,590 | A | 10/1972 | Webber et al. |
| 3,803,453 | A | 4/1974 | Hull |
| 3,806,401 | A | 4/1974 | Brinkhoff et al. |
| 3,828,543 | A | 8/1974 | Goodbar et al. |
| 3,882,667 | A | 5/1975 | Barry |
| 3,955,022 | A | 5/1976 | Sands |
| 3,969,559 | A | 7/1976 | Boe |
| 3,987,613 | A | 10/1976 | Woods et al. |
| 4,010,784 | A | 3/1977 | Nattrass et al. |
| 4,207,937 | A | 6/1980 | Sandeman et al. |
| 4,247,596 | A | 1/1981 | Yee |

(Continued)

FOREIGN PATENT DOCUMENTS

| | | |
|---|---|---|
| EP | 0353386 A2 | 2/1990 |

OTHER PUBLICATIONS

U.S. Appl. No. 60/137,615, filed Jun. 3, 1999, Fisher et al.

(Continued)

*Primary Examiner*—Nasser Ahmad
(74) *Attorney, Agent, or Firm*—Roberts, Mardula & Wertheim LLC

(57) ABSTRACT

This invention relates to ungrounded type flexible fabric container with a reduced energy of electrostatic discharge suitable for use in a combustible environment. A woven fabric is configured to form a flexible fabric container having sidewalls, a top feature and a bottom feature. The woven fabric flexible bulk container is made from a static dissipating fabric comprising fabric woven of non-conductive tapes, to which a plurality of bicomponent conductive staple fibers are added. The bicomponent conductive staple fibers have one or more longitudinal stripes of a carbon loaded conductive constituent on an outer surface of a non-conductive constituent. Preferably the staple fibers are woven into or coated onto the fabric at a spacing of from 3 mm to 100 mm.

20 Claims, 1 Drawing Sheet

U.S. PATENT DOCUMENTS

| | | | | |
|---|---|---|---|---|
| 4,362,199 | A | 12/1982 | Futerman | |
| 4,364,424 | A | 12/1982 | Nattrass | |
| 4,369,622 | A | 1/1983 | Teed et al. | |
| 4,420,534 | A | 12/1983 | Matsui | |
| 4,422,483 | A | 12/1983 | Zins | |
| 4,431,316 | A | 2/1984 | Massey | |
| 4,493,109 | A | 1/1985 | Nattrass | |
| 4,499,599 | A | 2/1985 | Polett et al. | |
| 4,519,201 | A | 5/1985 | Toon | |
| 4,606,968 | A | 8/1986 | Thornton et al. | |
| 4,610,028 | A | 9/1986 | Nattrass | |
| 4,643,119 | A | 2/1987 | Langston et al. | |
| 4,753,088 | A | 6/1988 | Harrison et al. | |
| 4,756,941 | A | 7/1988 | McCullough et al. | |
| 4,771,596 | A | 9/1988 | Klein | |
| 4,856,299 | A | 8/1989 | Bryant | |
| 5,001,813 | A | 3/1991 | Rodini | |
| 5,026,603 | A | 6/1991 | Rodini | |
| 5,071,699 | A | 12/1991 | Pappas et al. | |
| 5,092,683 | A * | 3/1992 | Wurr | 383/24 |
| 5,102,727 | A | 4/1992 | Pittman | |
| 5,167,264 | A | 12/1992 | Kälin | |
| 5,202,185 | A | 4/1993 | Samuelson | |
| 5,288,544 | A | 2/1994 | Mallen et al. | |
| 5,305,593 | A | 4/1994 | Rodini et al. | |
| 5,478,154 | A | 12/1995 | Pappas et al. | |
| 5,512,355 | A | 4/1996 | Fuson | |
| 5,679,449 | A | 10/1997 | Ebadat et al. | |
| 5,698,148 | A | 12/1997 | Asher et al. | |
| 5,747,134 | A * | 5/1998 | Mohammed et al. | 428/57 |
| 5,763,069 | A * | 6/1998 | Jordan | 428/323 |
| 5,776,608 | A | 7/1998 | Asher et al. | |
| 5,780,572 | A | 7/1998 | Graham | |
| 5,790,926 | A | 8/1998 | Mizoe et al. | |
| 5,840,425 | A | 11/1998 | Hodan | |
| 5,916,506 | A | 6/1999 | Breznak et al. | |
| 5,938,338 | A | 8/1999 | McDonough | |
| 5,952,099 | A | 9/1999 | Asher et al. | |
| 6,017,610 | A | 1/2000 | Abe et al. | |
| 6,057,032 | A | 5/2000 | Green | |
| 6,112,772 | A | 9/2000 | Ebadat et al. | |
| 6,228,492 | B1 | 5/2001 | Kinlen et al. | |
| 6,242,094 | B1 | 6/2001 | Breznak et al. | |
| 6,287,689 | B1 | 9/2001 | Elliott et al. | |
| 6,413,635 | B1 | 7/2002 | Martin et al. | |
| 6,451,407 | B1 | 9/2002 | Nickell | |
| 2002/0136859 | A1 | 9/2002 | Fisher et al. | |

OTHER PUBLICATIONS

Hoechst Celanese's Dictionary of Fiber and Textile Technology; copyright Hoechst Celanese Corporation, pp. 16, 23, 60, 96, 149.

"Manufacture of Spun Yarn" by Peyton B. Hudson, Anne C. Clapp and Darlene Kness, Joseph's Introductory Textile Science, Sixth Ed., Harcourt Brace Jovanovich College Publishers, Chapter 16, pp. 163-174.

"Electrostatic Properties of Materials," Fed. Test Method Std. No. 101B, Method 4046, Appendix B, Jan. 15, 1969, pp. 55-58.

"Electrostatic Discharge Control", by Owen J. McAteer, McGraw-Hill Publishing Co., N.Y. (1990) pp. 119-120.

"Testing the Suitability of FIBCs for Use in Flammable Atmospheres" by V. Ebadat and James Mulligan, 15, 3 (Fall 1996).

"A Study of The Electrostatic Behavior of Carpets Containing Conductive Yarns" by LeAnn Kessler and W. Keith Fisher, J. of Electrostatics 39 (1997) pp. 253-275.

"Static Electricity Dissipation Mechanism in Carpets Containing Conductive Fibers" by W. Keith Fisher as presented at the Mar. 30 Electrostatics 1999 conference in Cambridge, UK.

"Flexible Intermediate Bulk Containers (FIBCs)", Flexible Intermediate Bulk Container Association.

Nelson, M.A., Rogers, R.L., Gilmartin, B.P. "Anti Static Mechanisms Associated with FIBC Fabrics Containing Conductive Fibres." Journal of Electrostatics, 30 (1993) 135-148. Elsevier Science Publishers B.V.

Ebadat, Vahid; Cartwright, Paul "Electrostatic Hazards in the Use of Flexible Intermediate Bulk Containers." IChemE Symposium Series No. 124, pp. 105-117, Apr. 1991.

Wilson, N. "The Electrostatic Spark Discharging Behaviour of Some Flexible, Intermediate Bulk Containers." Paper given at conference—Recent Developments in the Assessment of Electrostatic Hazards in Industry, Sep. 28, 1989, London, England, organized by IBC Technical Services Ltd.

Britton, Laurence G. "Static Hazards Using Flexible Intermediate Bulk Containers for Powder Handling." Process Safety Progress, vol. 12, No. 4, Oct. 1993. American Institute of Chemical Engineers.

"Untangling the Terminology of Static Protection." Plastics World, Mar. 1989, p. 46.

Exxon Chemical: Polymers Group. "Static Electricity and FIBC's." Promotional product information, undated.

Exxon Chemical: Polymers Group. "BAXON Blue." Promotional product information with attached data sheet dated Oct. 1, 1991.

Linq Industrial Fabrics, Inc. "Static Electricity and FIBCs." Promotional product information with attached data sheets dated Dec. 1, 1992.

E. I. Du Pont De Nemours and Company. "NEGA-STAT: The New Standard in Static Dissipative Fibers." Fax date stamp of Feb. 28, 1994.

Dyer, M.J. "NEGA-STAT Comparative Test Data." E. I. du Pont de Nemours and Company, Jul. 18, 1994.

E. I. Du Pont De Nemours and Company. "Caution: Current Test Methods Could be Hazardous to Your Environment!" Promotional materials for NEGA-STAT fiber, undated.

E. I. Du Pont De Nemours and Company. "NEGA-STAT: The Anti-Static Fiber That Won't Come Out in the Wash." Informational materials. Fax date stamp of Oct. 28, 1993.

E.I. Du Pont De Nemours and Company. "The Effectiveness of Static Dissipative Fibers and Fabrics." Promotional videotape for NEGA-STAT fiber, 1993.

Roy, M. et al. "Polymer Nanocomposite Dielectrics—The Role of the Interface." IEEE Transactions on Dielectrics and Electrical Insulation, vol. 12, No. 4, Aug. 2005. Institute of Electrical and Electronics Engineers.

Stevens, N. John; Jones, Michael R. "Environmentally-Induced Discharges on Solar Arrays in Geosynchronous Orbit." IEEE Transactions on Nuclear Science, vol. 40, No. 6, Dec. 1993. Institute of Electrical and Electronics Engineers.

Yamaguma, Mizuki; Kodama, Tsutomu. "Observation of Propagating Brush Discharge on Insulating Film with Grounded Antistatic Materials." IEEE Transactions on Industry Application, vol. 40, No. 2, Mar./Apr. 2004. Institute of Electrical and Electronics Engineers.

Ebadat, Vahid; Mulligan, James C. "Testing the Suitability of FIBCs for Use in Flammable Atmospheres." Process Safety Progress, vol. 15, No. 3, 1996. American Institute of Chemical Engineers.

Ebadat, Vahid; Mulligan, James C.; Pappas, Robert J. "Ungrounded Static Protective FIBCs." Paper presented at 9th Intl. Conf. on Electrostatics, Apr. 2-5, 1995. Inst. Phys. Conf. Ser. No. 43.

Glor, M. "Electrostatic Ignition Hazards Associated with Flammable Substances in the Form of Gases, Vapors, Mists and Dusts." Undated. Swiss Institute for the Promotion of Safety & Security.

Glor, M. "Electrostatic Ignition Hazards Associated with FIBC Filling or Emptying and Presently Available FIBC Safety Design Types." 1997. The Institution of Electrical Engineers.

Glor, Martin. "Hazards Associated with Filling and Emptying FIBCs and Presently Available Safety Measures." Undated; fax date stamp of Nov. 7, 1997. Swiss Institute for the Promotion of Safety & Security.

Britton, Laurence G. "Using Material Data in Static Hazard Assessment." Plant/Operations Progress, vol. 11, No. 2, Apr. 1992.

Dahn, C. James; Kashani, A.; Reyes, B. "Static Electricity Hazards of Flexible Intermediate Bulk Container (FIBC)." Process Safety Progress, vol. 13, No. 3, Jul. 1994. American Institute of Chemical Engineers.

* cited by examiner

ANTI-STATIC WOVEN FLEXIBLE BULK CONTAINER

CROSS REFERENCE TO OTHER PATENT APPLICATIONS

This application is a divisional of U.S. patent application Ser. No. 10/003,890 filed Oct. 25, 2001, now U.S. Pat. No. 6,675,838, that, in turn, claims priority under 35 U.S.C. 119 from U.S. provisional patent application Ser. No. 60/242,999 filed Oct. 25, 2000 of the same inventors, which are incorporated by reference in their entirety.

BACKGROUND OF THE INVENTION

In the past, various methods have been employed to produce anti-static woven fabrics suitable for flexible intermediate bulk containers (FIBC) or clean room garments. FIBCs are used in the packaging and transportation of dry substances such as metal ores, chemicals, foodstuffs and powders. They are designed to be handled with standard fork-lifts and typically hold from 500 to 4400 pounds of material. Common dimensions include 35 inch and 41 inch square cylinders.

Construction and manufacture of FIBCs is disclosed in references such as U.S. Pat. Nos. 4,364,424 and 4,610,028 to Nattrass. FIBCs may be customized by the top and bottom features. For example, the Flexible Intermediate Bulk Container Association (FIBC Association) identifies FIBCs with top features such as cone top, duffel top, top spout or open top. Similarly, the FIBC Association identifies FIBCs with bottom features such as bottom spout, side/bottom spout, full bottom, cone bottom and closed bottom.

A common hazard of FIBCs is electrostatic discharge (ESD). ESD hazard ranges from personnel nuisance shocks to sparks capable of igniting explosive mixtures of dust or flammable gases. As a result it is necessary to eliminate ESD from flexible intermediate bulk containers in certain applications.

Some of the textile fabrics used in FIBCs include polypropylene and Tyvek®. Polypropylene is particularly favored for FIBCs due to its inertness, strength and low cost. FIBCs made from woven polypropylene are disclosed in U.S. Pat. No. 5,071,699 to Pappas that is incorporated by reference herein.

FIBCs are either coated or uncoated. Uncoated FIBCs are breathable and allow transmission of moisture through the fabric. Coated FIBCs can restrict transmission of moisture; prevent dust escaping as well as having other special properties. For example, when ultraviolet light resistance is desired, a UV stabilizing coating is used. As an alternate, threads and yarns can be coated with a UV stabilizer before weaving into fabric.

Control of ESD from fabrics can be either conductive or dissipative. Conductive refers to the electrical conduction of any accumulated charge, to an electrical ground. Dissipative refers to the dissipation of static electricity through electrostatic discharges including corona discharges, spark discharges, brush discharges or propagating brush discharges. Spark, brush and propagating brush discharges can create incendiary discharges in many common flammable atmospheres. In contrast the corona discharges are generally below incendiary discharge energy levels.

Conductive fabrics require an electrically sufficient connection to a ground point. These fabrics function by draining an accumulating electrical charge to the ground. Any disruption in the ground connection disables their ESD control ability. Additionally, fabrication of containers formed of conductive fabrics requires specialized construction techniques to ensure all conductive surfaces are electrically connected together for a ground source.

In contrast, dissipative fabrics rely on the fabric, alone or in conjunction with an antistatic coating, to discharge charges at levels below those that cause damage or create a spark capable of igniting flammable material (for example by corona discharge). Examples of dissipative fabrics are disclosed in U.S. Pat. No. 5,512,355 to Fuson and assigned to E. I du Pont and U.S. Patents assigned to Linq Industrial Fabrics, including U.S. Pat. No. 5,478,154 to Pappas et al, U.S. Pat. No. 5,679,449 to Ebadat et al, U.S. Pat. No. 6,112,772 to Ebadat et al.

The fabrics disclosed in U.S. Pat. No. 5,512,355 comprise polypropylene yarns interwoven with sheath-core filament yarns. The sheath-core filament yarns further comprise semi-conductor carbon black or graphite containing core and a non-conducting sheath. The filaments are interlaced in the fabric at between ¼ and 2 inch intervals. In a preferred embodiment, the filaments are crimped so that stretching of the sheath-core yarn does not break the electrical continuity of the semi-conductor core. A noted disadvantage of sheath-core filaments is the relatively high cost of resultant yarns.

The fabrics disclosed (but not claimed) in the Linq Industries assigned patents also comprise sheath-core yarns interwoven with non-conductive yarns or superimposed over non-conductive yarns. Such fabrics are identified as "quasi-conductive," conduct electricity through the fabric and have surface resistivity of $10^9$ to $10^{12}$ ohms per square and the sheath-core yarns are identified as "quasi-conductive" with a resistance of $10^8$ ohms per meter. In order to attain the disclosed surface resistivity an antistatic coating is utilized. Without antistatic coating, the sheath-core yarns must be placed at a narrow spacing with the effective discharge area between the sheath-core yarns limited to 9 mm.

These patents teach against the use of conductive fibers in ungrounded antistatic applications. When relying upon the sheath-core yarns for static dissipation these fabrics are costly. In contrast, when relying on antistatic coating alone, such fabrics are susceptible to failure if the coating becomes removed during use. Additionally, when FIBCs comprise such fabrics are filled with non-conductive powders a surface charge potential of −32 kV (negative 32 kV) can be attained.

U.S. Pat. No. 5,071,699 to Pappas et al. discloses the use of conductive fibers in ungrounded antistatic fabric further comprising an antistatic coating. The resultant surface resistivity of the fabric is 1.75 times $10^{13}$ to 9.46 times $10^{13}$. When the coating is not present the disclosed fabrics do not adequately dissipate static charges. As a result, care must be taken to preserve the integrity of the coating.

The above patents are incorporated by reference. It is seen from the above that what is needed is a dissipative antistatic fabric that does not rely upon antistatic coatings or sheath-core filament yarns.

As a result, it is seen that a more robust anti-static textile fabric capable of preventing high surface charge levels is desirable, particularly a fabric that does not rely upon anti-static coatings or narrow spacing of quasi-conductor yarns.

BRIEF SUMMARY OF THE INVENTION

The present invention comprises ungrounded type flexible fabric containers with a reduced energy of electrostatic discharge suitable for use in combustible environments. A woven fabric is configured to form a flexible fabric container having sidewalls, a top feature and a bottom feature. The woven fabric flexible bulk container is made from a static dissipating fabric comprising fabric woven of non-conductive tapes, to which a plurality of bicomponent conductive staple fibers are added. The bicomponent conductive staple fibers have one or more longitudinal stripes of a carbon loaded conductive constituent on an outer surface of a non-conductive constituent. Preferably the staple fibers are woven into or coated onto the fabric at a spacing of from 3 mm to 100 mm.

DETAILED DESCRIPTION OF THE INVENTION

Figure 1:
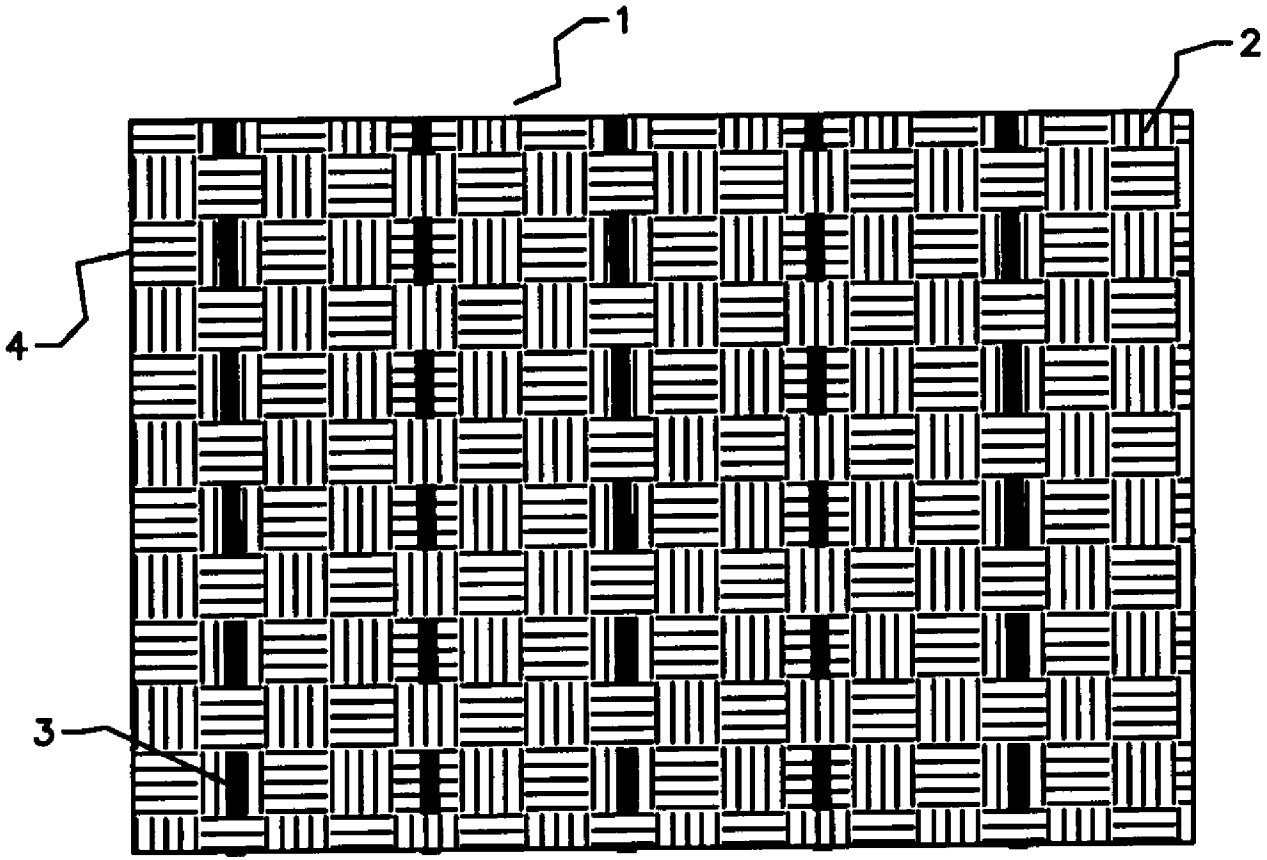
FIG. 1 schematically illustrates one embodiment of fabric used in construction of the invention.

The present invention relates to the method of producing anti-static fabric that is subsequently used in producing ungrounded flexible intermediate bulk containers (FIBC). FIG. 1 shows a representative cross-sectional view of such a fabric. The fabric generally designated as 1 comprises a non-conductive fabric of non-conductive tapes 2 and 4 into which a staple yarn 3 comprised of conducting segments is woven in either the weft or warp directions. In one embodiment the staple yarn is woven in the weft direction at intervals from 3 mm to 100 mm. When used as a fabric for flexible intermediate bulk containers (FIBC) the interval is preferably from 10 mm to 100 mm, and more preferably 25 mm. When used as a fabric for clean room garments, the interval is preferably 3 mm to 25 mm.

At greater intervals for the staple yarn, less corona discharge points are available. At distances greater than about 100 mm, the antistatic properties of the fabric become limited and reliance on antistatic coating effects is requisite. At very short intervals the antistatic properties are superior. However, at short intervals the cost and difficulty of manufacture increases. A good balance between needed antistatic property and cost is achieved at a 25 mm interval for fabric to be utilized in FIBCs.

The non-conductive tapes 2 and 4 of FIG. 1 may be any suitable non-conductive tapes. One embodiment of the invention comprises polypropylene non-conductive tapes. Common polypropylene tapes of 500 to 4000 denier and width of 1.7 mm to 10 mm are suitable. Polypropylene tapes narrower than 1.7 mm are often too thick and brittle for weaving into the fabric. Similarly polypropylene tapes wider than 10 mm are typically too thin and frequently break during weaving.

The staple yarn 3 of FIG. 1 may comprise any suitable conductive staple yarn with carbon loaded conductive polymer paths on the surface of the yarn. For example, suitable yarns are available from Solutia Inc. as No Shock® yarns. For example, No-Shock® 285-E3S yarn is such a suitable yarn.

Manufacture of staple yarn is known in the art and consists of spinning multiple short lengths of fibers together. For example, a staple yarn may contain fibers of a consistent 1.5 inch length that are spun together into a single multi-fiber yarn. In such yarns, each staple length is separate from each other length with only casual mechanical contact between lengths. As a result, when the staple lengths are further comprised of conductor or semi-conductor fibers, electrical discontinuity exists between staple lengths.

Surprisingly, it has been determined that the electrical discontinuity enhances the ability of the yarn to control electrostatic charge densities in an ungrounded fabric. It is thought that the shorter conductor segments limit the capacitance of the yarn thereby reducing charge density. In addition, the numerous sites of electrical discontinuity provide greater numbers of corona discharge sites than methods heretofore disclosed. As a result, superior anti-static performance is accomplished with fabric comprising such yarns. Similarly, fabrics with equivalent anti-static performance are produced from lesser amounts of conducting yarn or with yarn at a wider spacing.

Surprisingly when fabrics are produced incorporating such yarn, they are capable of dissipating electrical static charges without the use of anti-static coatings.

The invention is illustrated, but not limited by the following examples:

EXAMPLES AND PREFERRED EMBODIMENTS

Tests were performed on FIBCs sewn of fabrics comprised of three different conductive staple yarns woven into a non-conductive 6.5 ounce fabric at intervals of 1 inch. Conductive staple yarn designated as yarn #1 comprise an antistatic yarn consisting of a core of continuous conductive fibers surrounded by a sheath of staple fibers produced via standard core spinning techniques. Equal portions by weight of core continuous fibers and sheath staple fibers are used. The core continuous conductive fibers are bicomponent fibers consisting of a sheath of conductive polymer (nylon 6,6 loaded with about 30% weight carbon) completely surrounding a core of non-conductive nylon. The total denier of the formed antistatic yarn is 616.

Conductive staple yarn designated as yarn #2 comprise an antistatic yarn consisting of 50% weight conductive staple fibers and 50% weight non-conductive fibers produced via standard ring-spinning techniques. The conductive staple fibers are obtained starting from an 18 denier, 2 continuous fiber yarn, wherein each filament is a bicomponent conductive "racing stripe" fiber having 3 longitudinal stripes of a carbon loaded conductive constituent on the surface of a non-conductive nylon constituent (No-Shock® 18-2E3N yarn from Solutia, Inc.) This starting material is twice drawn to 4.5 denier per filament, then cut to a fiber length of 1.5 inches and ring spun with non-conductive nylon staple fibers (2.1 denier per filament, 1.5 inch fiber length). The total denier of the formed antistatic yarn is 471.

Conductive staple yarn designated as yarn #3 comprise an antistatic yarn consisting of a core of continuous conductive fibers surrounded by a sheath of conductive staple fibers is produced via a standard DREF core spinning technique. Equal portions by weight of core continuous fibers and sheath staple fibers are used. The core continuous conductive fibers are bicomponent fibers consisting of a sheath of conductive polymer (nylon 6,6 loaded with about 30% weight carbon) completely surrounding a core of non-conductive nylon. The surrounding conductive staple fibers are the same twice-drawn 4.5 denier per filament, 3-"racing stripe" fibers described in yarn #2. The total denier of the formed antistatic yarn is 632.

Table 1 indicates results obtained during incendivity testing of FIBCs sewn from fabrics comprising the three different conductive staple yarns. The three sample fabrics and the compare fabric included antistatic yarn woven into the fabric at an interval of about 25 mm. Sample 1 included comprised yarn #1, sample 2 comprised yarn #2 and sample #3 comprised yarn #3. Compare fabric comprised yarn formed from continuous lengths of the antistatic fibers of yarns #1, #2 and #3.

Testing indicates that when the fabric comprises continuous conductive yarn as opposed to staple conductive yarn the fabric fails the incendivity test. Of importance is the external nature of the antistatic yarn. Yarns of both conductive and non-conductive cores performed properly when the exterior comprised staple yarn segments. Such incendivity testing demonstrates the reduced energy nature of the corona discharges that are below incendiary discharge energy levels.

TABLE 1

Discharge Incendivity Test
(4.4% Propane in Air, Ignitions occur at 0.24 to 0.25 mJoules)

| Sample | Number of Ignitions (Ambient Humidity) | Number of Ignitions (Low Humidity) | Mean Max. Surface Potential (kV, Ambient Humidity) | Mean Max. Surface Potential (kV, Low Humidity) |
|---|---|---|---|---|
| 1 | 0 of 100 tests | 0 of 100 tests | −10 | −10.9 |
| 2 | 0 of 100 tests | 0 of 100 tests | −11.5 | −10.9 |
| 3 | 0 of 100 tests | 0 of 100 tests | −8.5 | −11.1 |
| Compare Fabric | 99 of 100 tests | 99 of 100 tests | −37.3 | −37.8 |
| Standard FIBC | 100 of 100 tests | 100 of 100 tests | −57.3 | −53.1 |

For testing, each FIBC was filled with a test powder, polypropylene pellets, at a rate of one kilogram per second and in accordance with procedures in the reference document "Testing the Suitability of FIBCs for Use in Flammable Atmospheres", Vol. 15, No. 3, 1996 AIChE. As seen in Table 1, all three FIBCs comprising antistatic fabrics of the present invention passed incendiary testing. Noteworthy is the low surface potential produced in these fabrics as compared to standard polypropylene FIBC or FIBCs comprised of compare fabrics.

When fabrics are used in FIBCs, it is common to coat the fabrics for improved retention of contents as well as resistance to ultraviolet light and other atmospheric oxidants. An example of a preferred coating is:

1.0 mil coating further comprised of:

73.5% polypropylene homopolymer

19% low density polyethylene 1.5% Ultraviolet Light absorbers (for example MB176 available from Synergistics)

6% of a dilute antistatic coating (for example AS6437B available from Polymer Products)

Surprisingly it has been determined that the antistatic coating, although helpful, is not essential to the adequate antistatic performance of the fabric. As a result, sufficient antistatic performance is present after instances of coating failure. Examples of causes of coating failures include abrasive wear, chemical, ultraviolet and other environmental causes.

Further testing confirmed that the fabrics of the present invention prevent incendiary discharges without the presence of antistatic coating. In a more rigorous testing of antistatic performance, sample fabric #1 was first coated with a 1 mil coating comprising:

79.5% polypropylene homopolymer

19% low density polyethylene 1.5% Ultraviolet Light absorbers (for example MB176 available from Synergistics)

This fabric was then tested in an ethylene atmosphere capable of ignition at 0.07 mJoules (as opposed to 0.24–0.25 mJoules of Table 1). No incendiary discharges were observed after 100 tests. This demonstrates that the need for expensive antistatic coatings is eliminated in the present invention.

Another preferred embodiment of the invention is 3.0 ounce rated fabric comprising fabric woven of non-conductive tapes, to which a plurality of conductive staple fibers are woven or coated into the fabric at a spacing of from 3 mm to 100 mm, preferably at a spacing from 10 mm to 100 mm, and most preferably at a spacing of 25 mm. The non-conductive tapes form a polypropylene fabric further comprising 11 of 900 denier tapes/inch in the warp direction and 9 of 1300 denier tapes/inch in the weft direction. The tapes further comprise polypropylene homopolymer with ultraviolet inhibitors. Coatings may be applied to the fabric to improve content retention and moisture exclusion properties. One embodiment of the invention uses a coating comprising 73.5% weight polypropylene homopolymer; 19% weight low density polyethylene polymer; 1.5% weight ultraviolet inhibitors and 6% weight of 25% weight antistatic masterbatch.

One embodiment of the invention is 6.5 ounce rated fabric comprising fabric woven of non-conductive tapes, to which a plurality of conductive staple fibers are woven or coated into the fabric at a spacing of from 3 mm to 100 mm, preferably at a spacing from 10 mm to 100 mm, and most preferably at a spacing of 25 mm. The non-conductive tapes form a polypropylene fabric further comprising 16 of 1600 denier tapes/inch in the warp direction and 12 of 2300 denier tapes/inch in the weft direction. The tapes further comprise polypropylene homopolymer with ultraviolet inhibitors. Coatings may be applied to the fabric to improve content retention and moisture exclusion properties. One embodiment of the invention uses a coating comprising 73.5% weight polypropylene homopolymer; 19% weight low density polyethylene polymer; 1.5% weight ultraviolet inhibitors and 6% weight of 25% weight antistatic masterbatch.

Another embodiment of the present invention provides an ungrounded type flexible fabric container with a reduced energy of electrostatic discharge for use in a combustible environment. The container comprises a woven fabric configured to from the flexible fabric container having sidewalls, a closed end and an open end. The container is made from static dissipating fabric comprising fabric woven of non-conductive tapes of polypropylene, preferably homopolymers, having a melt flow index of 1–6 g/10 min. with a preferred melt flow index of about 3 g/10 min. The tapes have a denier from 500 to 4000 and tape width from 0.07 to 0.40 inches. At any given denier, lower width values result in tapes that are too thick and brittle. This leads to difficulty in weaving. Higher width values lead to tape that is too thin for this application. The tape becomes too wide and leading to problems in drawability and breaks. The fabric may be coated with a layer of molten or extruded polypropylene polymer. The coating is preferably a polypropylene homopolymer with a melt index value of greater than 10 g/10 min. and a preferred value of 10–60 g/10 min. Into the fabric a plurality of strands that dissipate electrostatic charges. The strands are made from conductive staple fibers and are woven into or coated onto the fabric at a spacing of from 3 mm to 100 mm. A preferred spacing is to include a dissipative strand about every inch (25 mm) of the fabric. When woven into the fabric, the dissipative strands are introduced at the time of weaving the fabric.

Although the present invention has been described in terms of specific embodiments, various substitutions of materials and conditions can be made as will be known to those skilled in the art. For example, other polyolefin materials may be used for the non-conductive tapes of the fabric. Other variations will be apparent to those skilled in the art and are meant to be included herein. The scope of the invention is only to be limited by the claims set forth below.

OTHER REFERENCES

1. "Testing the Suitability of FIBCs for Use in Flammable Atmospheres", Vahid Ebadat, James C. Mulligan, *Process Safety Progress*, Vol. 15, No. 3, AlChe.
2. Temporary PRODUCT SPECIFICATION for NOSHOCK® CONDUCTIVE FIBER/STAPLE BLEND 285-ES3, October 2000, Solutia, Inc.
3. Prototype FIBC test results from Chilworth Technology dated Sep. 14, 2000
4. Prototype fabric test results from Institute of Safety & Security Test Report 20200664.01.5050.
5. "Flexible Intermediate Bulk Containers (FIBCs), Strong, Economical and Designed to fit your needs.", Brochure, Flexible Intermediate Bulk Container Association

What is claimed is:

1. An ungrounded type flexible fabric container with a reduced energy of electrostatic discharge for use in a combustible environment without the need for antistatic coatings comprising: a woven static dissipating fabric configured to form the flexible fabric container having side walls, a top feature and a bottom feature; and said woven static dissipating fabric comprises fabric woven of non-conductive tapes, to which a plurality of antistatic yarn segments are woven into or coated onto the fabric at a spacing of from 3 mm to 100 mm and wherein the antistatic yarn segments comprise yarn segments of conductive and non-conductive staple fibers and wherein the conductive staple fibers are fibers having a conductive constituent on an outer surface of a non-conductive constituent and wherein the conductive constituent is formed into one or more longitudinal stripes.

2. An ungrounded type flexible fabric container of claim 1 wherein the woven static dissipating fabric further comprises 11 of 900 denier tapes/inch in the warp direction and 9 of 1300 denier tapes/inch in the weft direction; wherein tapes further comprise polypropylene homopolymer with ultraviolet inhibitors.

3. An ungrounded type flexible fabric container of claim 2 wherein the antistatic yarn segments comprise 50% by weight non-conductive staple fibers and 50% by weight conductive staple fibers.

4. An ungrounded type flexible fabric container of claim 2 wherein the conductive staple yarn is woven into the fabric at a spacing from 10 mm to 100 mm.

5. An ungrounded type flexible fabric container of claim 2 wherein the conductive staple yam is woven into the fabric at a spacing of 25 mm.

6. An ungrounded type flexible fabric container of claim 2 wherein the static dissipating fabric further comprises a polymeric coating.

7. An ungrounded type flexible fabric container of claim 6 wherein the polymeric coating comprises 79.5% weight polypropylene homopolymer; 19% weight low density polyethylene polymer and 1.5% weight ultraviolet inhibitors.

8. An ungrounded type flexible fabric container of claim 7 wherein the conductive staple yam is woven into the fabric at a spacing of 25 mm.

9. An ungrounded type flexible fabric container with a reduced energy of electrostatic discharge for use in a combustible environment without the need for antistatic coatings comprising: a woven fabric configured to form the flexible fabric container having side walls, a top feature and a bottom feature; and said woven fabric made from static dissipating fabric comprising fabric woven of non-conductive tapes of polypropylene having a melt flow index of 1–6 g/10 min. and wherein the tapes have a denier from 500 to 4000 and tape width from 0.07 to 0.40 inches, to which a plurality of antistatic yarn segments are woven into or coated onto the fabric at a spacing of from 3 mm to 100 mm and wherein the antistatic yarn segments comprise yarn segments of conductive and non-conductive staple fibers and wherein the conductive staple fibers are fibers having a conductive constituent on an outer surface of a non-conductive constituent and wherein the conductive constituent is formed into one or more longitudinal stripes.

10. The container of claim 9 wherein the fabric further comprises a coating layer of polypropylene polymers having a melt flow index greater than 10 g/10 min.

11. An ungrounded type flexible fabric container with a reduced energy of electrostatic discharge for use in a combustible environment comprising: a woven fabric configured to form the flexible fabric container having side walls, a top feature and a bottom feature; and said woven fabric made from static dissipating fabric comprising fabric woven of non-conductive tapes, to which a plurality of antistatic yam segments are woven into or coated onto the fabric at a spacing of from 3 mm to 100 mm and wherein the antistatic yam segments comprise yam segments of conductive and non-conductive staple fibers and wherein the conductive staple fibers comprise a bicomponent conductive staple fiber having 1 or more longitudinal stripes of a carbon loaded conductive constituent on an outer surface of a non-conductive constituent.

12. An ungrounded type flexible fabric container of claim 11 wherein the woven fabric further comprises 11 of 900 denier tapes/inch in the warp direction and 9 of 1300 denier tapes/inch in the weft direction; wherein tapes further comprise polypropylene homopolymer with ultraviolet inhibitors.

13. An ungrounded type flexible fabric container of claim 11 wherein the antistatic yam segments comprise 50% by weight non-conductive staple fibers and 50% by weight conductive staple fibers.

14. An ungrounded type flexible fabric container of claim 11 wherein the conductive staple yarn is woven into the fabric at a spacing of 25 mm.

15. An ungrounded type flexible fabric container of claim 11 wherein the static dissipating fabric further comprises a polymeric coating.

16. An ungrounded type flexible fabric container of claim 15 wherein the polymeric coating comprises 79.5% weight polypropylene homopolymer; 19% weight low density polyethylene polymer and 1.5% weight ultraviolet inhibitors.

17. An ungrounded type flexible fabric container of claim 16 wherein the conductive staple yarn is woven into the fabric at a spacing of 25 mm.

18. An ungrounded type flexible fabric container with a reduced energy of electrostatic discharge for use in a combustible environment without the need for antistatic coatings comprising: a woven fabric configured to form the flexible fabric container having side walls, a top feature and a bottom feature; and said woven fabric made from static dissipating fabric comprising fabric woven of non-conductive tapes of polypropylene having a melt flow index of 1–6 g/10 min. and wherein the tapes have a denier from 500 to 4000 and tape width from 0.07 to 0.40 inches, to which a plurality of antistatic yarn segments are woven into or coated onto the fabric at a spacing of from 3 mm to 100 mm and wherein the antistatic yarn segments comprise yarn segments of conductive and non-conductive staple fibers and wherein the conductive staple fibers comprise a bicomponent conductive staple fiber having 1 or more longitudinal stripes of a carbon loaded conductive constituent on an outer surface of a non-conductive constituent.

19. The container of claim 18 wherein the fabric further comprises a coating layer of polypropylene polymers having a melt flow index greater than 10 g/10 min.

20. The container of claim 18 wherein the antistatic yarn segments comprise 50% by weight non-conductive staple fibers and 50% by weight conductive staple fibers.

* * * * *